US010933453B2

(12) United States Patent
Zink et al.

(10) Patent No.: US 10,933,453 B2
(45) **Date of Patent: *Mar. 2, 2021**

(54) APPARATUS FOR REMOTELY PROPELLING A FLEXIBLE LANCE INTO AND OUT OF A PIPING SYSTEM

(71) Applicant: STONEAGE, INC., Durango, CO (US)

(72) Inventors: Gerald P. Zink, Durango, CO (US); Joseph Schneider, Durango, CO (US)

(73) Assignee: STONEAGE, INC., Durango, CO (US)

( * ) Notice: Subject to any disclaimer, the term of this patent is extended or adjusted under 35 U.S.C. 154(b) by 208 days.

This patent is subject to a terminal disclaimer.

(21) Appl. No.: 16/354,700

(22) Filed: Mar. 15, 2019

(65) Prior Publication Data

US 2019/0210077 A1 Jul. 11, 2019

Related U.S. Application Data

(63) Continuation of application No. 15/374,585, filed on Dec. 9, 2016, now Pat. No. 10,272,480.

(51) Int. Cl.

| | |
|---|---|
| ***B08B 9/043*** | (2006.01) |
| ***F28G 1/16*** | (2006.01) |
| ***F28G 15/04*** | (2006.01) |
| ***B08B 9/045*** | (2006.01) |

(52) U.S. Cl.

CPC ..... *B08B 9/043* (2013.01); *B08B 9/045* (2013.01); *B08B 9/0433* (2013.01); *F28G 1/163* (2013.01); *F28G 15/04* (2013.01)

(58) Field of Classification Search

CPC ..... B65H 2404/15; B65H 2404/152; B08B 9/02; B08B 9/027; B08B 9/043; B08B 9/04; F28G 15/00; F28G 15/04; F28G 15/06

See application file for complete search history.

(56) References Cited

U.S. PATENT DOCUMENTS

| | | | | |
|---|---|---|---|---|
| 3,459,354 A | | 8/1969 | Land et al. | |
| 4,095,305 A | | 6/1978 | Goodwin | |
| 4,235,362 A | * | 11/1980 | Hubenko | B21F 23/002 140/2 |

(Continued)

FOREIGN PATENT DOCUMENTS

| | | |
|---|---|---|
| DE | 3148225 | 6/1983 |
| DE | 29612512 | 11/1996 |

(Continued)

OTHER PUBLICATIONS

International Search Report and Written Opinion, dated Mar. 7, 2018, from related International Patent Application No. PCT/US2017/063096.

*Primary Examiner* — Tyrone V Hall, Jr.
(74) *Attorney, Agent, or Firm* — Greenberg Traurig, LLP

(57) ABSTRACT

A compact flexible lance propelling apparatus is disclosed that is mountable on a pipe end. The apparatus includes a drive mechanism, an adaptable support that can be fastened directly to the pipe end which carries the drive mechanism, a remote control console, and a hose take-up drum spaced from the drive mechanism. The drive mechanism includes a driven roller and a follower roller sandwiching the flexible lance hose therebetween and a rotary cam lift mechanism for linearly raising the follower roller to permit insertion of the flexible lance hose and lowering the follower roller against the driven roller.

20 Claims, 8 Drawing Sheets

(56) References Cited

U.S. PATENT DOCUMENTS

| | | | | |
|---|---|---|---|---|
| 4,266,709 | A | 5/1981 | Krüger | |
| 4,363,562 | A | 12/1982 | Hora | |
| 4,445,668 | A * | 5/1984 | Sauber | B65H 51/10 226/177 |
| 4,743,175 | A | 5/1988 | Gilmore | |
| 4,844,021 | A | 7/1989 | Stoss | |
| 4,944,465 | A | 7/1990 | Levine | |
| 5,002,120 | A | 3/1991 | Boisture et al. | |
| 5,320,072 | A | 6/1994 | Theiss et al. | |
| 5,782,255 | A | 7/1998 | Magnin et al. | |
| 6,192,904 | B1 | 2/2001 | Secknus et al. | |
| 6,390,389 | B1 | 2/2002 | Tudor et al. | |
| 6,557,742 | B1 | 5/2003 | Bobeczko et al. | |
| 6,557,850 | B1 | 5/2003 | Kallin et al. | |
| 7,475,865 | B2 * | 1/2009 | Jeong | H02G 1/08 254/134.5 |
| 8,048,234 | B2 | 11/2011 | Jacquinet | |
| 8,568,046 | B2 | 10/2013 | Campbell et al. | |
| 2009/0211612 | A1 | 8/2009 | Athanassiu et al. | |
| 2011/0155174 | A1 * | 6/2011 | Moll | B08B 9/027 134/8 |
| 2015/0034128 | A1 | 2/2015 | Brumfield | |
| 2015/0068563 | A1 | 3/2015 | Gzym et al. | |
| 2015/0176837 | A1 | 6/2015 | Hawkins | |
| 2016/0023264 | A1 | 1/2016 | Barnes | |

FOREIGN PATENT DOCUMENTS

| | | |
|---|---|---|
| DE | 19819406 | 11/1999 |
| GB | 1027717 | 4/1966 |
| GB | 2037392 | 7/1980 |
| GB | 2179637 | 3/1987 |
| GB | 2320076 | 6/1998 |
| JP | H06-029771 U | 4/1994 |
| WO | WO96/17695 | 6/1996 |
| WO | WO02/059538 | 8/2002 |
| WO | WO02/068134 | 9/2002 |
| WO | WO2005/003611 | 1/2005 |
| WO | WO2005/054770 | 6/2005 |
| WO | WO2006/021164 | 3/2006 |
| WO | WO2009/088484 | 7/2009 |

* cited by examiner

APPARATUS FOR REMOTELY PROPELLING A FLEXIBLE LANCE INTO AND OUT OF A PIPING SYSTEM

CROSS REFERENCE TO RELATED APPLICATIONS

This application is a continuation of U.S. patent application Ser. No. 15/374,585 filed Dec. 9, 2016, the content of which is incorporated by reference herein in its entirety.

BACKGROUND OF THE DISCLOSURE

The present disclosure is directed to high pressure fluid handling systems. In particular, embodiments of the present disclosure are directed to an apparatus for remotely driving a flexible cleaning lance and/or hose into a piping system to be cleaned.

One conventional tube lancing apparatus is described in US Patent publication No. 2015/0068563 published Mar. 12, 2015. Such a system includes take-up reel for lance hose, a lance feed motor, and a mounting frame fastened to, in this case, a tube sheet of a heat exchanger bundle.

For cleaning a piping system or tube bundle, a user typically will install a back-out preventer and splash shield to the end of the pipe or tube to be cleaned and push a hand held cleaning lance or hose into the piping system to be cleaned. This requires the user to stand relatively close to the back-out preventer, hence in the path of potentially dangerous fluid back flow and debris out of the piping system. In order for a user to get back out of the splash zone an elaborate frame system must be erected to which a flexible lance feed system is installed. What is needed is a simple lightweight apparatus for feeding a single flexible lance and/or hose into a piping system to be cleaned that is quick to set up, is adaptable to a variety of pipe system configurations, and which can be remotely operated from a distanced spaced from the splash zone.

SUMMARY OF THE DISCLOSURE

An adaptable flexible lance drive apparatus in accordance with the present disclosure directly addresses such needs. One embodiment of a flexible lance drive apparatus in accordance with the present disclosure includes a winch type pipe clamp assembly for fastening a positioner arm adjacent to and in alignment with an open end of a pipe to be cleaned, a T or L shaped support member having one end selectively attachable to the positioner arm, a back-out preventer collet block adjustably fastenable to a stem of the T or L shaped support member, the collet block having a tractor side portion and a pipe side portion, and a tractor drive fastened to and supported by a tractor side portion of the collet block. These collet block side portions are preferably symmetrically shaped. The tractor drive supports a pneumatic drive motor and a drive gearbox adjacent a drive housing.

A tractor drive roller assembly and an idler roller assembly are carried within the drive housing. The drive roller assembly is fastened to a drive axle extending into the housing from the drive gearbox. The idler roller assembly is adjustably supported parallel to the drive axle supporting the drive roller assembly by an idler shaft within the housing mounted on a slidable idler shaft slide plate. The idler shaft extends parallel to the drive axle, out of the housing, through a vertical slot in the housing and through a horizontally slidable eccentric plate. An eccentric bushing is rotatably carried in the eccentric plate. This eccentric bushing is fastened to the idler shaft.

Rotation of the eccentric bushing in a first direction causes the idler shaft to vertically raise the idler roller assembly above the drive roller assembly so that a flexible lance hose may be installed or removed from between the roller assemblies. Rotation of the eccentric bushing in an opposite direction causes the idler shaft to vertically lower the idler roller assembly into contact with the drive roller assembly thereby capturing the flexible lance hose therebetween.

The slidable idler shaft slide plate is vertically guided in its movement by a pair of vertical guides formed in or fastened to the housing side plate alongside the vertical slot. The eccentric plate is guided in its movement in a horizontal direction by a horizontal guide on an exterior surface of the tractor housing. A radial handle is attached to the eccentric for manually rotating the eccentric in the first direction and the opposite direction.

The positioner arm is an L shaped member having a short leg fastened to the winch clamp assembly and a long leg adapted to extend along an axis of the pipe to be cleaned. The long leg of the positioner arm fits within an end of the T or L shaped support member and includes a cross bore for receiving a removable pin through the support member and the long leg of the positioner arm to position the stem of the T or L shaped support member spaced from the end of the pipe to be cleaned.

An exemplary embodiment of the apparatus according to the present disclosure may alternatively be viewed as a tractor drive apparatus for feeding a flexible lance into a pipe to be cleaned that includes a tractor drive housing having a fixed side to which is fastened a pneumatic drive motor and a drive gearbox, a tractor drive roller assembly and an idler roller assembly carried within the drive housing. The drive roller assembly is fastened to a drive axle extending into the housing from the drive gearbox and the idler roller assembly is adjustably supported parallel to the drive axle supporting the drive roller assembly by an idler shaft within the housing mounted on a slidable idler shaft slide plate. The idler shaft extends parallel to the drive axle out of the housing through a vertical slot in the housing and through a horizontally slidable eccentric plate. An eccentric bushing rotatably carried in the eccentric plate is fastened to the idler shaft via a releasable hand bolt. Release of the hand bolt permits rotation of the eccentric bushing. Rotation of the eccentric bushing in a first direction causes the idler shaft to vertically raise the idler roller assembly above the drive roller assembly and rotation of the eccentric bushing in an opposite direction causes the idler shaft to vertically lower the idler roller assembly into contact with the drive roller assembly.

An exemplary embodiment of the present disclosure may be alternatively be viewed as a tractor drive apparatus for feeding a flexible lance into a pipe to be cleaned that includes a tractor drive housing having a fixed side to which is fastened a pneumatic drive motor and a drive gearbox, and a tractor drive roller assembly and an idler roller assembly carried within the drive housing. Each of the drive and idler roller assemblies includes a spline hub, a spline gear and a spline roller. The spline gear and roller are removably fastened to the spline hub. The drive roller assembly is fastened to a drive axle extending into the housing from the drive gearbox and the idler roller assembly is adjustably supported parallel to the drive axle supporting the drive roller assembly by an idler shaft within the housing mounted on a slidable idler shaft slide plate. The idler shaft extends parallel to the drive axle out of the housing through a vertical slot in the housing and through a horizontally slidable eccentric plate, and an eccentric bushing rotatably carried in the eccentric plate fastened to the idler shaft to a hand bolt. When the hand bolt is loosened, rotation of the eccentric bushing in a first direction causes the idler shaft to vertically raise the idler roller assembly above the drive roller assembly and rotation of the eccentric bushing in an opposite direction causes the idler shaft to vertically lower the idler roller assembly into contact with the drive roller assembly. The slidable idler shaft slide plate is vertically guided by a pair of vertical guides alongside the vertical slot and the eccentric plate is guided along a horizontal guide on an exterior surface of the tractor housing.

Further features, advantages and characteristics of the embodiments of this disclosure will be apparent from reading the following detailed description when taken in conjunction with the drawing figures.

DETAILED DESCRIPTION

Figure 1:
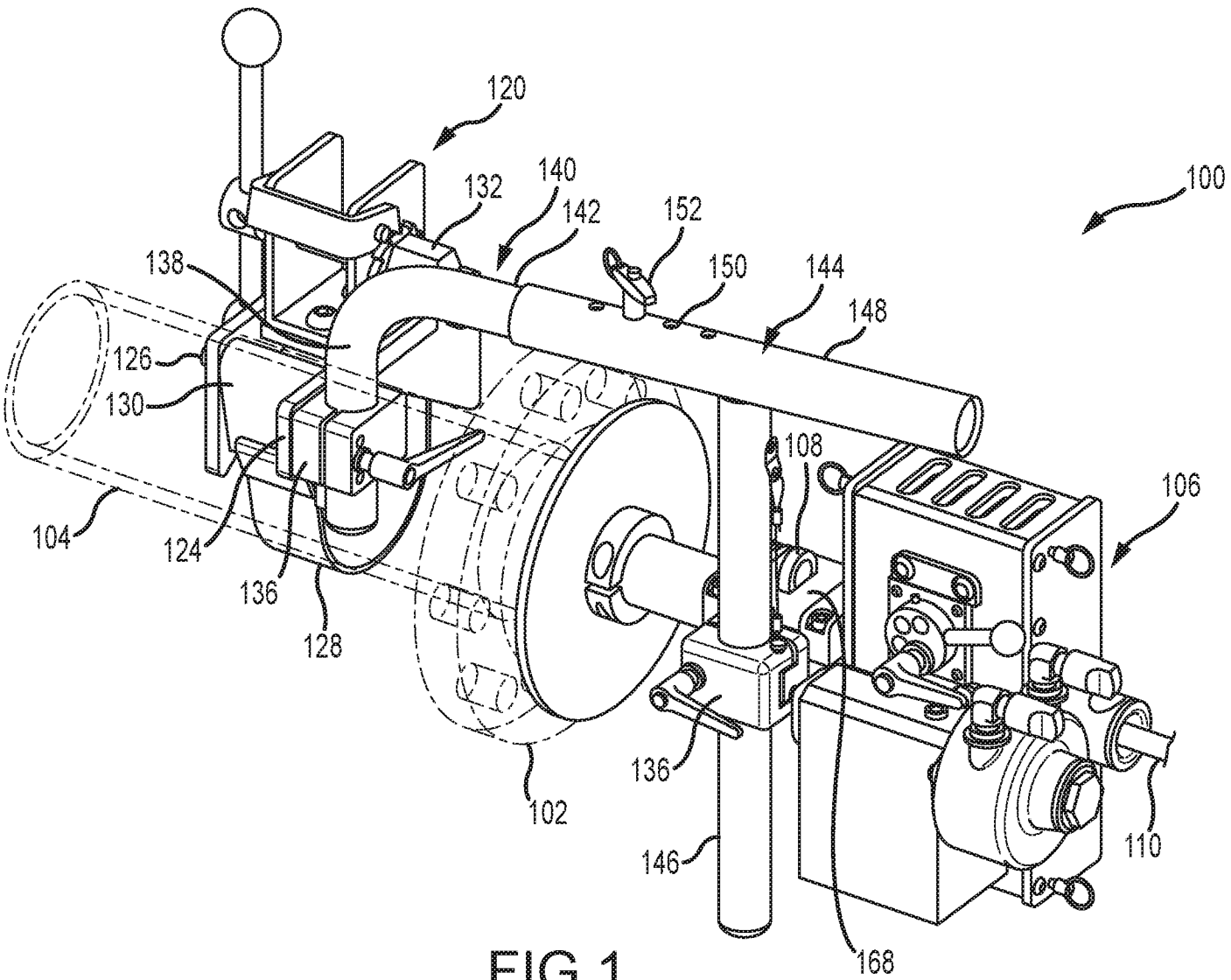
FIG. 1 is a left perspective view of an exemplary apparatus in accordance with the present disclosure fastened to a pipe to be cleaned.
Figure 2:
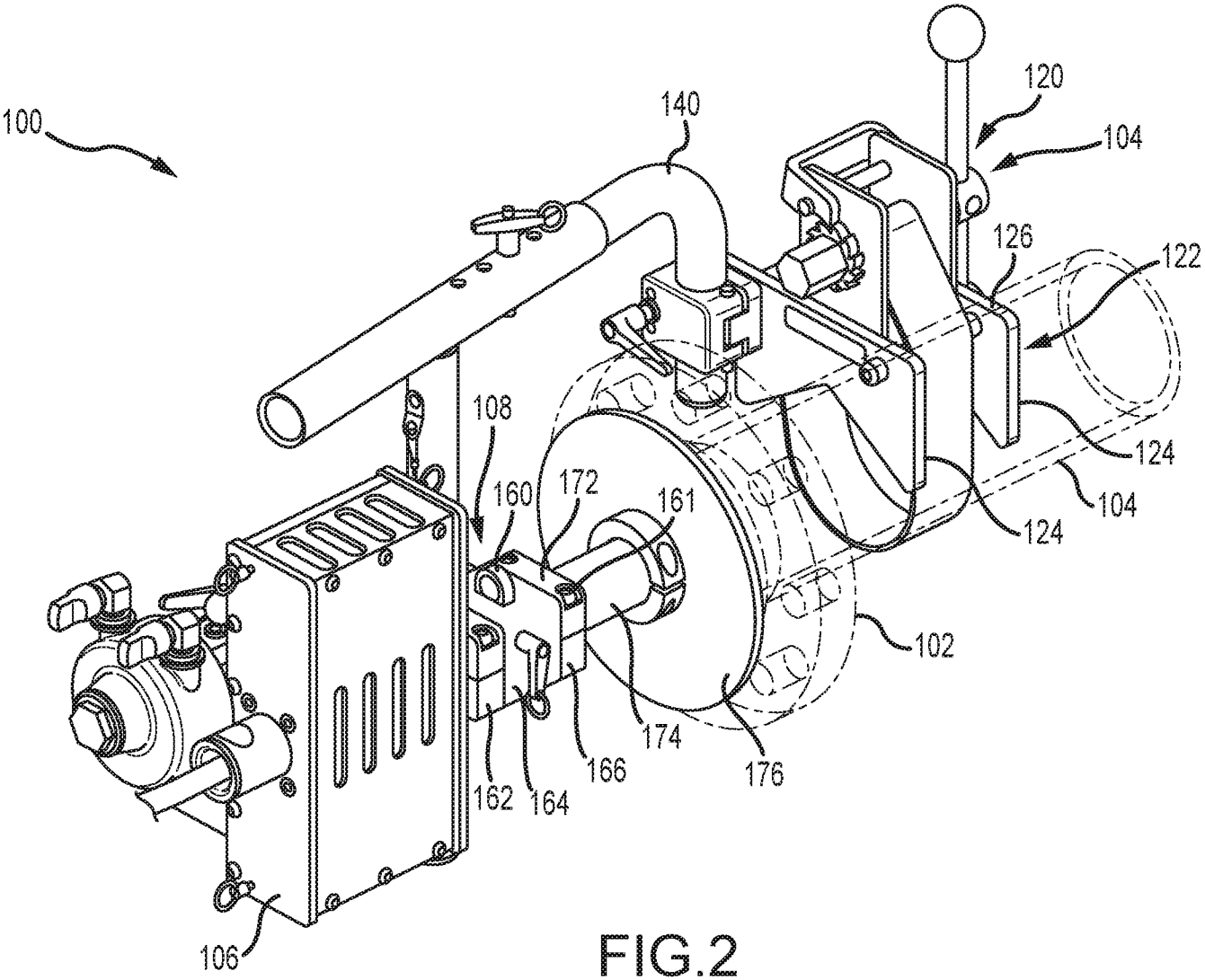
FIG. 2 is a right perspective view of the apparatus shown in FIG. 1.

An exemplary apparatus 100 in accordance with the present disclosure is shown in a left perspective view in FIG. 1 fastened behind a pipe flange 102 of an exemplary pipe 104. This apparatus 100 is shown in a right perspective view in FIG. 2. The apparatus 100 may be configured differently than as specifically shown in FIGS. 1 and 2 depending on the environment surrounding the end of the particular pipe 104 that is to be cleaned. The apparatus 100 in this exemplary embodiment includes a winch pipe clamp assembly 120 that fastens a support tube positioner arm 140 to the pipe 104, a tractor support member 144 fastened to the positioner arm 140, a flexible lance tractor 106 and a back-out preventer collet block 108 fastened to the support member 144 and the tractor 106. The apparatus 100 directs a flexible lance 110 through the tractor 106 and back-out preventer collet block 108 into and out of the pipe 104.

The winch pipe clamp assembly 120 has a V block weldment 122 that includes first and second V plates 124 spaced apart by two roller bars 126, preferably with a welded web inbetween the plates 124 and bars 126. A webbing strap 128 has one end fastened via a metal "J" plate 130 to one of the roller bars 126. The other end of the strap 128 passes over the other roller bar 126 and onto the axle 132 of a ratchet tie down winch 134 bolted to the V block weldment 122.

A hinged tube clamp 136 is bolted to a one of the V block weldment plates 124. This tube clamp 136 receives and adjustably fastens one leg 138 of an L shaped positioner arm 140 to the winch pipe V block weldment 122. The L shaped positioner arm 140 is positioned in the clamp 136 such that the other leg 142 of the positioner arm 140 is aligned preferably parallel to or at an off axis angle and spaced from the central axis of the pipe 104. The winch pipe clamp assembly 120 is light weight and can be removed quickly and reattached to a different pipe 104 to be cleaned with minimal difficulty.

A tractor support member 144 is adjustably fastened to the leg 142 of the positioner arm 140. This tractor support member 144 may be a T shaped welded tube having a stem 146 joining a top tube 148 that adjustably slips over the leg 142 of the positioner arm 140 and can be secured at selectable hole locations 150 via a removable pin 152. Fastening the stem 146 of the tractor support member 144 to the tractor 106 is another tube clamp 136 bolted to the back-out preventer collet block 108.

The back-out preventer collet block 108 is a solid metal body, preferably made of aluminum, with a central passage through a tractor side portion 162, a collet receiving portion 164 and a tube side portion 166. The tractor and tube side portions 162 and 166 of the block 108 are half round and preferably symmetrically shaped. A C shaped tractor side half round cap 168 is bolted to the tractor side portion to capture an outlet fitting 170 (See FIG. 7) of the tractor 106. A tube side cap 172 is bolted to the tube side portion 166 of the block 108 to capture a lance guide tube 174 leading to a splash guard 176 that faces the pipe 104 to be cleaned. A removable U shaped collet 160 is shown installed in the collet receiving portion 164. This collet 160 is a safety device that has an opening that closely fits over a flexible lance hose 110 such that it allows free passage of the lance hose 110 but engages either a part of the nozzle or another fitting (not shown) close to the nozzle to prevent further or unwanted withdrawal of the lance 110. Each lance size requires a different size collet 160. A retainer pin 161 is inserted into the collet receiving portion 164 of the collet block 108 to retain the collet 160 in place.

The splash guard 176 may be a circular plate 178 with the central tube 174 captured in the tube side portion 166 of the collet block 108 that faces the flange 102 of the pipe 104 to be cleaned. Alternately the splash guard 176 may have a different configuration, such as a quarter round plate 180 used to mount the tractor to a bolted flange or other design that helps prevent splash back of cleaning water/fluid and debris out of the pipe being cleaned. The circular plate 178 is thus merely exemplary.

Figure 3:
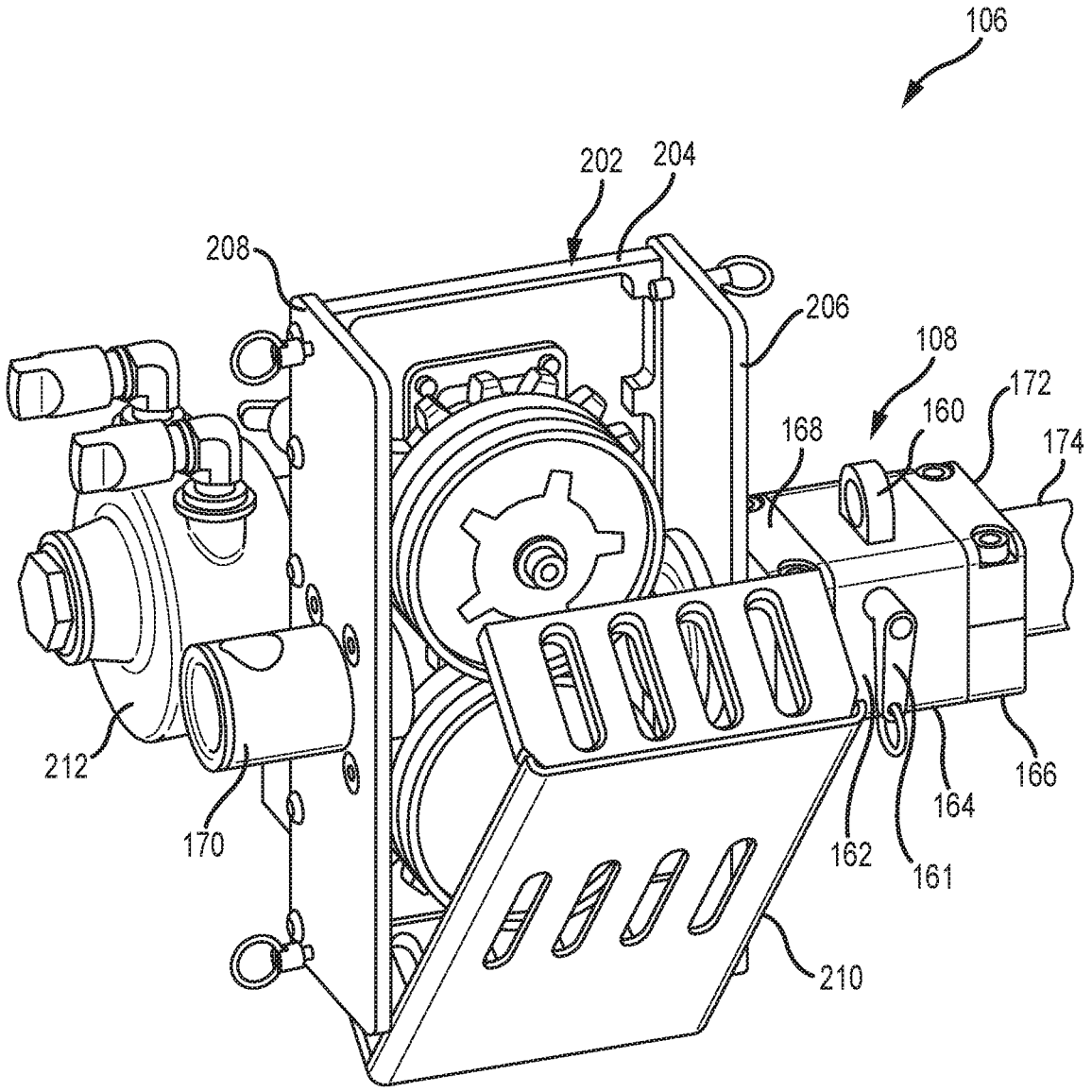
FIG. 3 is partial perspective view of the apparatus shown in FIG. 2 with the side wall open to permit exchange of the rollers.
Figure 4:
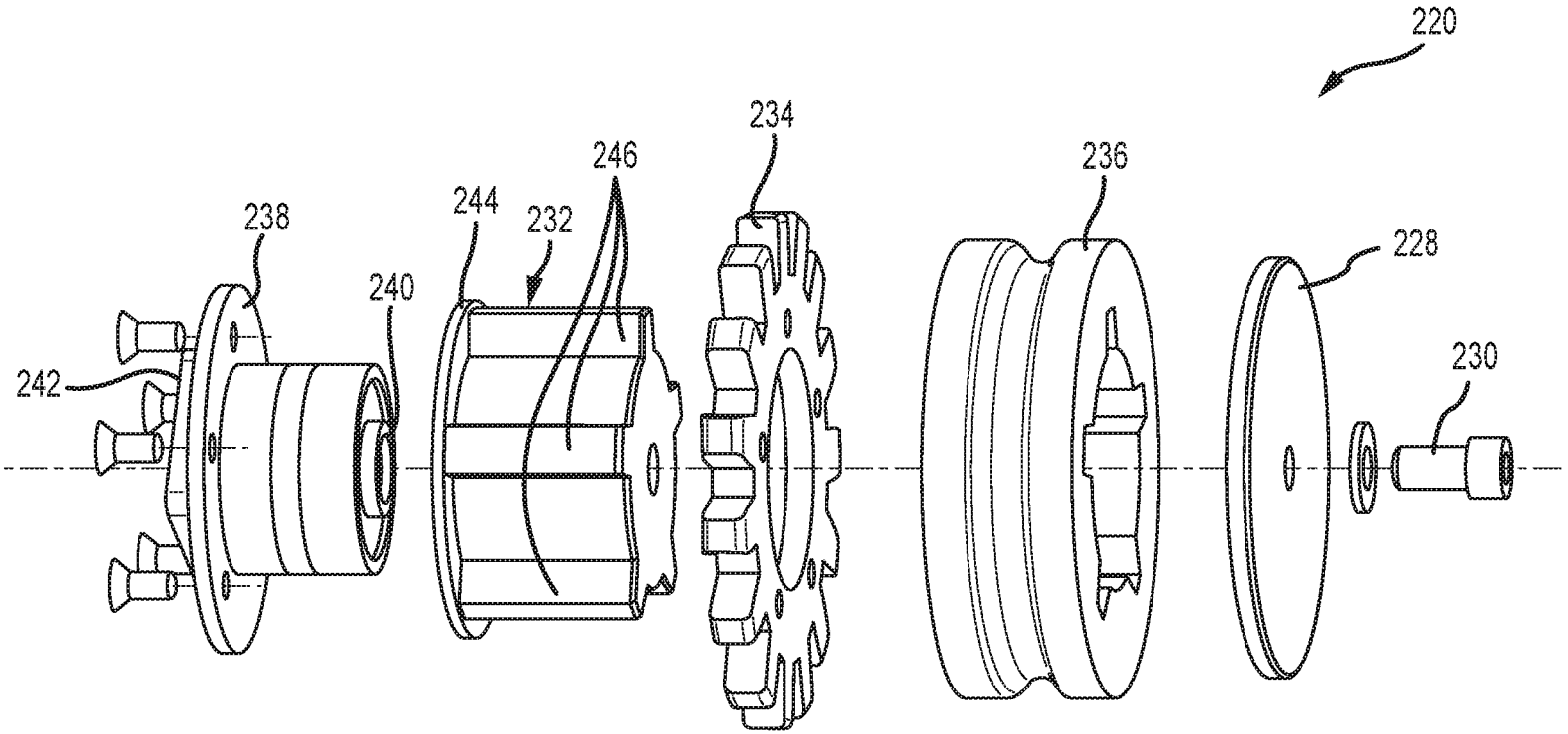
FIG. 4 is a separate exploded perspective view of the idler roller assembly.
Figure 5:
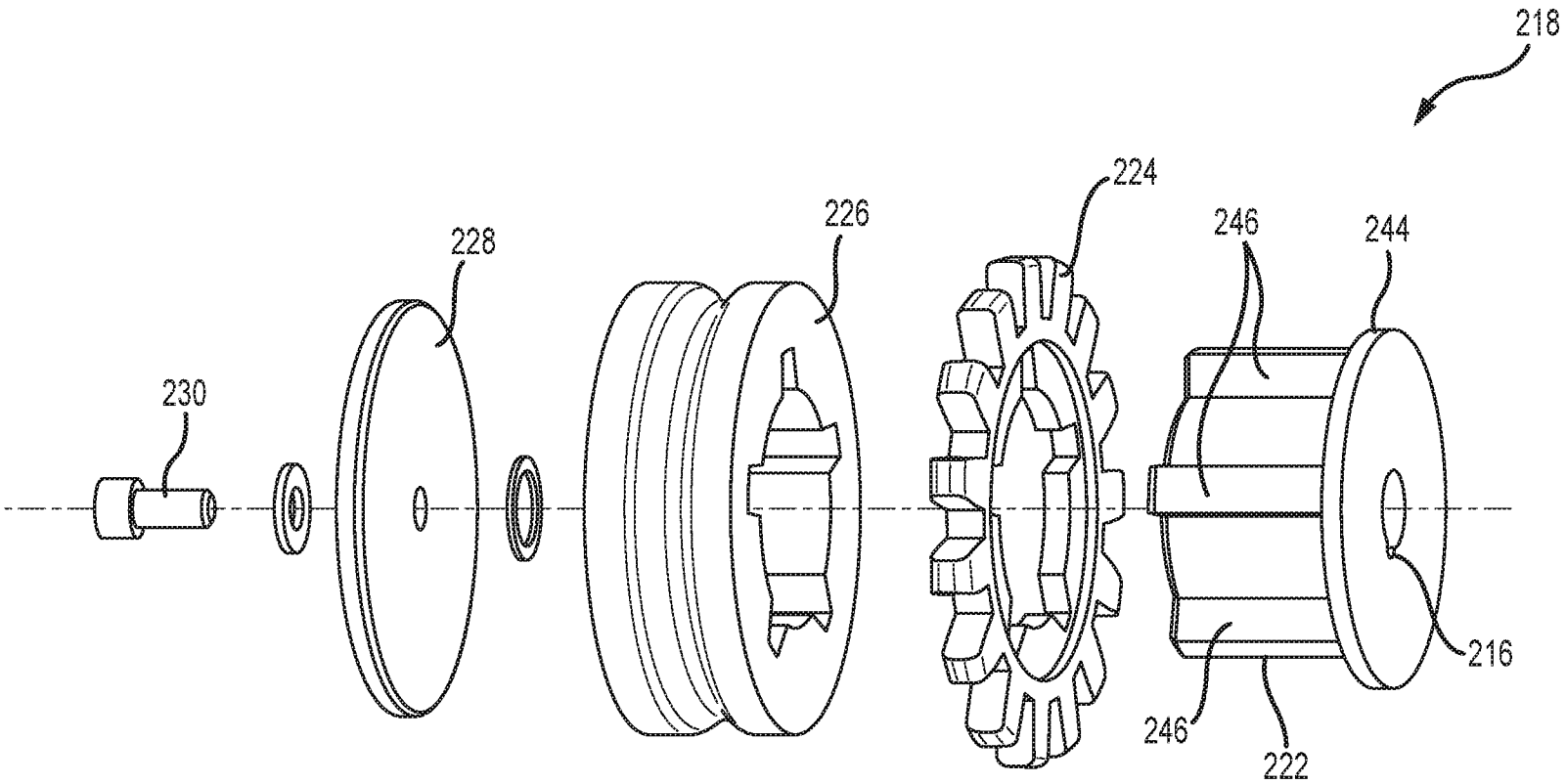
FIG. 5 is a separate exploded perspective view of the drive roller assembly.
Figure 7:
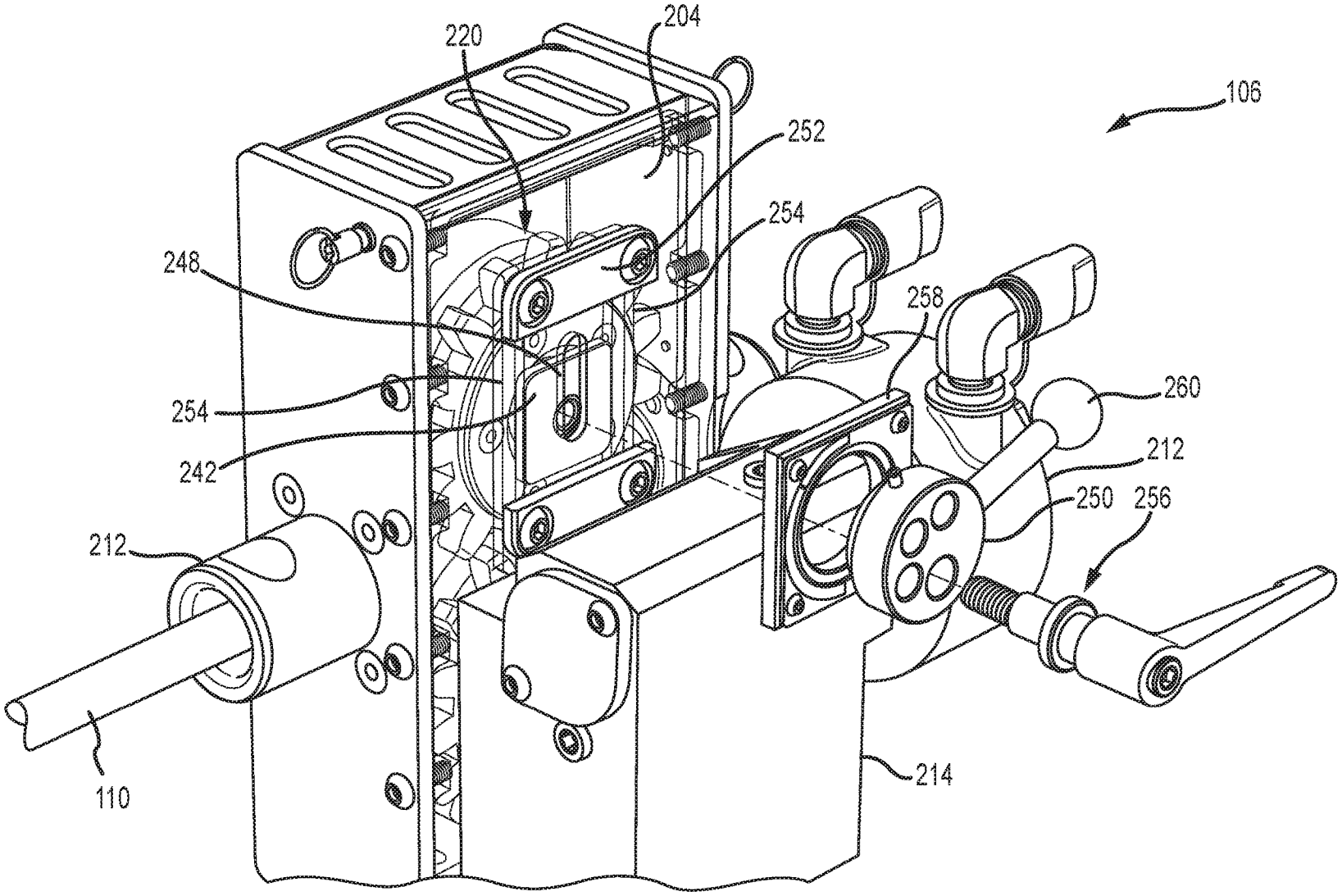
FIG. 7 is a left perspective view of the tractor shown in FIG. 1 with portions in an exploded view and the idler roller fully engaged with the drive roller assembly.
Figure 8:
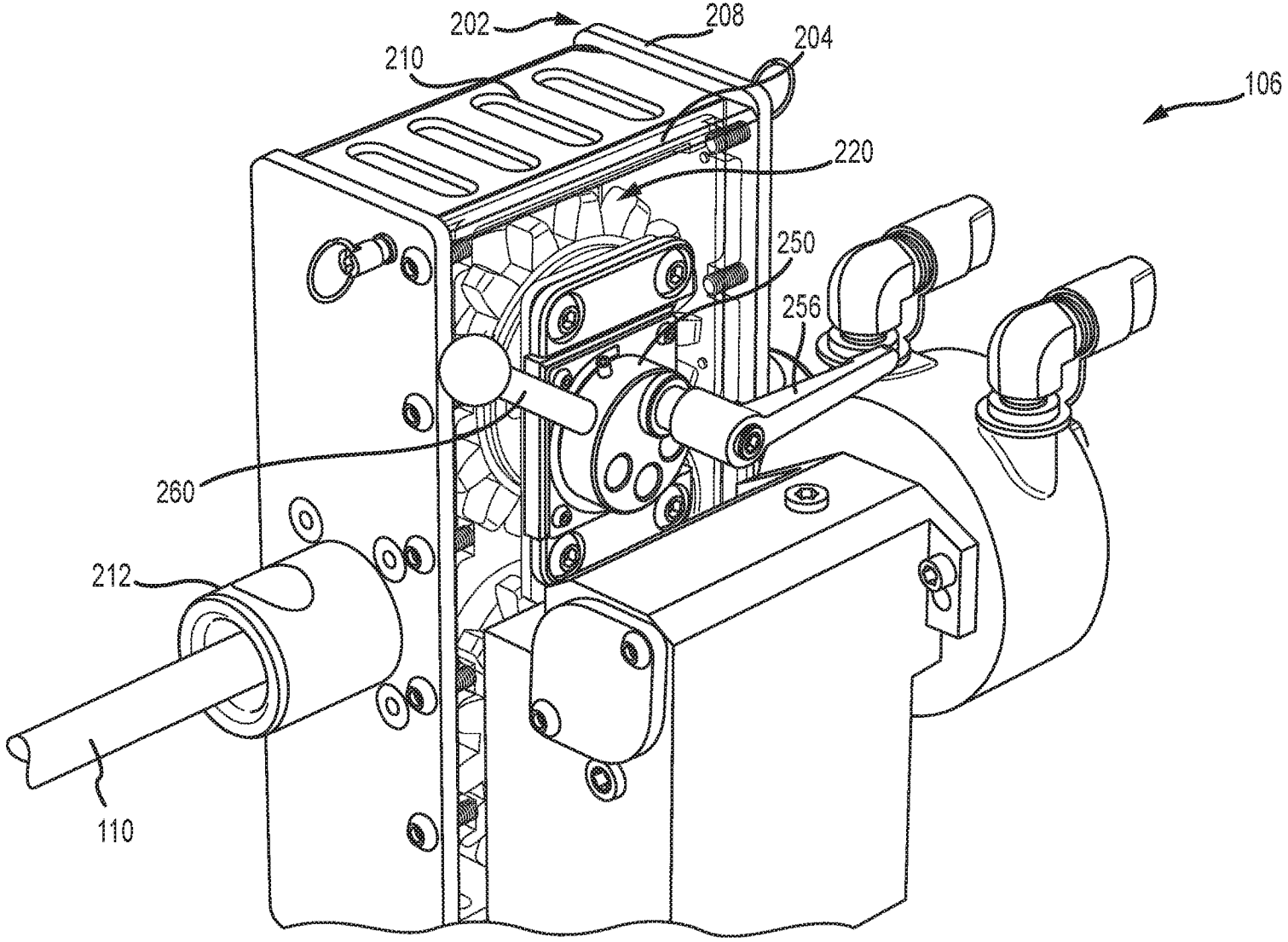
FIG. 8 is a left perspective view as in FIG. 7 with the idler roller assembly disengaged.

The tractor drive 106, shown separately in FIGS. 3, 7 and 8 includes a generally rectangular tractor drive housing 202 that preferably has a fixed side wall 204 fastened to a front wall 206 and a rear wall 208, and preferably a clamshell side wall 210 that is pivotally attached to lower corners of the front and rear walls 206 and 208. A drive motor 212 and gearbox 214 are fastened to the fixed side wall 204. The gearbox 214 includes a drive axle (not shown) that extends laterally out of the gearbox 214 through an opening through the fixed side wall 204 into the interior of the housing 202 perpendicular to the side wall 204.

Each of the walls 204, 206, 208, and 210 may be made of a light metal plate material such as aluminum. Optionally other materials could be used such as a steel, stainless steel, structural plastic or fiberglass plate material having the requisite structural strength and rigidity. For example, the fixed side wall 204 may be made of aluminum while the front, rear and clamshell walls could be made of a composite fiber material. The rear wall 208 of the housing 202 supports an entrance stub tube 212. The front wall 206 of the housing 202 supports an exit stub tube fitting 170 that is in turn fastened to the tractor side portion 162 of the collet block 108. Thus in the embodiment 100 shown in FIGS. 1-8, the collet block 108 fully supports the tractor 106. In turn, the collet block 108 is supported by the tractor support member 144 which is cantilever supported on the pipe 104 by the winch pipe clamp assembly 120. Hence minimizing the weight of the apparatus 100 is an important consideration and important for portability. The weight of the complete apparatus 100 less the winch pipe clamp assembly 120 is currently less than 30 pounds. In some applications, the winch pipe clamp assembly 120 and support 140 and 144 may not be needed. For example, the splash guard 176 could be replaced with a plate directly mounted to the pipe flange 102 and the tractor 108 and the collet block 108 fastened to that plate or other support member.

A drive axle gearbox 214 and a fluid drive motor 212 are fastened to the outside of fixed wall 204 of the housing 202. In the illustrated embodiment, the drive motor 212 is a bidirectional pneumatic motor. The drive motor 212 could alternatively be a hydraulic or electrical motor. However, pneumatic motors are usually preferred. The gearbox 214 provides a reduction ratio suitable for the task involved, and may, for example, be 5:1, 10:1 or about 20:1 in order to provide appropriate torque to the drive roller assembly 218 for operation of the apparatus 100 to suitably propel a flexible lance 110 into and out of the pipe 104. The drive roller assembly 218 and an idler roller assembly are separately shown in FIGS. 4 and 5.

An idler roller assembly 220 is slidably carried by the fixed wall 204 in the housing 202 vertically above the drive roller assembly 218. This idler roller assembly 220 may be manually moved vertically up and down as explained in more detail below to capture or release a flexible lance 110 between the roller assemblies 218 and 220.

The drive roller assembly 218 has a drive spline hub 222 that is keyed via keyway 216 onto the gearbox drive axle (extending within the spline hub 222 but not visible in the figures shown) within the housing 202. A spline gear 224 and a spline load roller 226 are sequentially mounted on the drive spline hub 222. The spline hub 222 and a face plate 228 are then fastened to the axle via a bolt 230.

The idler roller assembly 220 has a spline idler hub 232 to which is mounted a spline gear 234 and a spline load roller 236 followed by a face plate and a bolt 230. The spline idler hub 232 is bolted to an idler bearing plate 238 supported by an idler shaft 240 such that the hub 232 together with the bearing plate 238 are free to rotate on bearings on the idler shaft 240. This idler shaft 240 has a rectangular slide plate 242 fastened to it at one end. The other end of the idler shaft 240 carries the bearings, the bearing plate 238 and spline idler hub 232.

The spline hubs 222 and 232 each have an identical external shape, having a disc shaped end wall 244 and 5 equally spaced rounded splines 246 spaced around its cylindrical outer surface. The spline load rollers 226 and 236 and spline gears 224 and 234 have internal shapes complementary to the outer surface shape of the spline hubs 222 and 232. Any number of splines 246 may be provided on the hubs 222 and 232. Hence 5 equally spaced splines are merely exemplary. They are provided so as to preclude slippage of the load rollers and spline gears on the hubs.

The spline load rollers 226 and 236 each have external half round grooves having a radius matched to a particular range of flexible lance 110 hose diameters. For example, for conventional poly lance hose sizes 4/2, 6/2, and 8/4 the diameters are 0.34 in., 0.46 in. and 0.58 in. respectively. Thus a 0.46 in. rollers work for hoses ranging from 0.39 to 0.50 inch O.D.

Turning now to the tractor 106 shown in FIGS. 7 and 8, the fixed side wall 204 is shown transparent. As can be seen in FIG. 7, a pair of raised vertical internal guides 254 are formed on the inside surface of the fixed side wall 204 spaced from and parallel to the vertical slot 248. A horizontal raised guide 252 is formed in the exterior surface of the side wall 204 extending across the vertical slot 248.

The idler roller assembly 220 is fastened to the fixed side wall 204 of the housing 202 through the vertical slot 248 spaced above the drive axle via an eccentric bushing 250 that is bolted to the slide plate 242 on the idler shaft 240 by a hand bolt 256. The hand bolt 256 passes through the eccentric bushing 250, a horizontal slide plate 258, through the vertical slot 248, and into the rectangular slide plate 242 on the end of the idler shaft 240. When the hand bolt 256 is tightened, the idler roller assembly 220 is securely fastened and fixed to the fixed side wall 204 of the housing 202 of the tractor 106. Loosening the hand bolt 256 allows the idler roller assembly 220 to be adjusted vertically.

The eccentric bushing 250 is a cylindrical solid body that has a recessed circular end rotatably carried in the horizontal slide plate 258. The hand bolt 256 passes axially through the eccentric bushing 250 off center such that when the hand bolt 256 is loosened, rotation of the bushing 250 raises the hand bolt 256 in an arc about the center of the eccentric bushing 250. The eccentric bushing 250 has a radially extending handle 260. This handle 260 is used to raise the idler assembly 220 vertically away from the drive roller assembly 218, to a position as shown in FIG. 8 when the hand bolt 256 is loosened, in order to insert and/or remove a flexible lance 110 from between the load rollers 226 and 236.

Although rotation of the handle 260 causes the eccentric bushing 250 to rotate in an arc, the hand bolt 256 is constrained to move only vertically away from or toward the drive axle 216. This constrained movement is due to the constrained movement of the slide plate 242 between the vertical guides 254 and constrained movement of the eccentric horizontal slide plate 258 against the horizontal guide 252. The end result is that rotation of the handle 260 causes the hand bolt 256 to move only vertically toward and away from the drive axle 214.

In order to raise the idler roller assembly 220, a user would first loosen the hand bolt 256. Then the user grasps the handle 260 and rotates the handle 260 counterclockwise to disengage the idler roller assembly 220 from the drive roller assembly 218. As the handle 260 rotates, the horizontal slide plate 258 slides to the left, and the slide plate 242 raises up between the internal vertical guides 254 until the hand bolt 256 is at its highest point. At this position the idler roller assembly 220 is fully disengaged from the drive roller assembly 218 and a lance 110 may be inserted or removed from between the rollers 226 and 236. Clockwise rotation of the handle 260 reverses the process and the idler roller assembly 220 is lowered into full contact with the drive roller assembly 218. The hand bolt 256 is then tightened to maintain the idler roller assembly position.

The drive and idler rollers are, for example, preferably about 3.75 inch in diameter and are pressed more or less together depending on traction conditions of the tractor 106 in operation. In some applications, it is best to maximize traction. In others, it is desirable to allow easy slippage. Such reduced traction can reduce hose damage from frictional heat and avoid kinking if the hose is overloaded in compression when it encounters an obstacle. With a looser grip, the apparatus 100 is more free-running and sensitive, which allows for better operator control at light thrust conditions and accommodates the range of hose ODs used.

The radius of the U-shaped cross section of the roller grooves is slightly less than half the hose diameter for a given hose size. For example, first four point contact is made at about 3.90 in. shaft spacing (between drive axle and idler roller shaft 240). The drive and idler roller material is preferably a 95 durometer urethane. Roller deformation progresses as the shaft spacing is reduced to about 3.70 in. The contact pressure and the length of full contact zone on the hose increases to about one hose diameter at this spacing.

Figure 6:
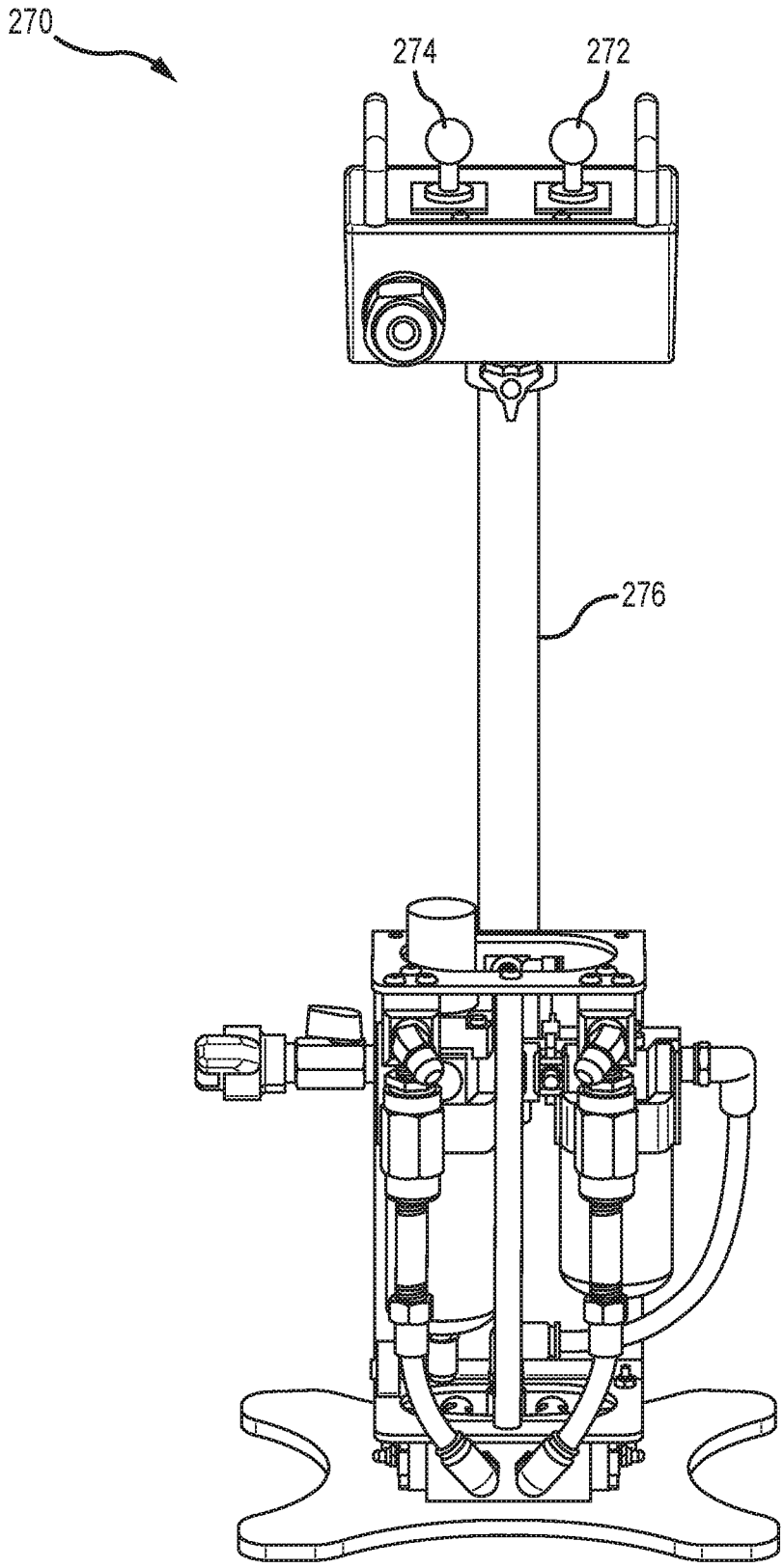
FIG. 6 is a perspective view of an exemplary remote control console.

A remote console 270 shown in FIG. 6 directs a supply of pneumatic pressure to the drive motor 212 of the tractor 106 from a safe distance, typically 10 meters or more from the location of the pipe 104 and the apparatus 100. The remote console 270 has directional controls 272 (forward and reverse) for the tractor 106 and a dump valve control lever 274 for remotely shutting off the supply of high pressure water to the flexible lance 110. The remote console 270 may be compact, to be worn around a user's neck, or may be fastened to a floor support 276 or other structure. A suitable lance hose take-up drum or reel may also be provided to feed out, take in and restore lance hose.

Many changes may be made to the apparatus above described. For example, the guides 252 and 254 may be strips of material fastened to a flat sheet side wall or may be molded into or stamped into the side wall 204. Alternatively the slide plates 242 and 258 may be formed with ribs that slide in corresponding channels or grooves formed in the side wall 204 during rotation of the eccentric bushing 250. Therefore, all such changes, alternatives and equivalents in accordance with the features and benefits described herein, are within the scope of the present disclosure. Such changes and alternatives may be introduced without departing from the spirit and broad scope of this disclosure as defined by the claims below and their equivalents.

What is claimed is:

1. An apparatus for reversibly driving a flexible lance into a piping system to be cleaned, the apparatus comprising:

a winch pipe clamp assembly for fastening a positioner arm adjacent to an open end of a pipe to be cleaned;

a T or L shaped support member having one end selectively attachable to the positioner arm;

a back-out preventer collet block adjustably fastenable to a stem of the T or L shaped support member, the collet block having a tractor side portion and a pipe side portion; and a tractor drive fastened to and supported by the tractor side portion of the collet block, the tractor drive supporting a pneumatic drive motor and a drive gearbox adjacent a tractor drive housing.

2. The apparatus according to claim 1 further comprising a tractor drive roller assembly and an idler roller assembly carried within the tractor drive housing, wherein the drive roller assembly is fastened to a drive axle extending into the tractor drive housing from the drive gearbox and the idler roller assembly is adjustably supported parallel to the drive axle supporting the drive roller assembly by an idler shaft within the tractor drive housing mounted on a slidable idler shaft slide plate, wherein the idler shaft extends parallel to the drive axle out of the tractor drive housing through a vertical slot in the tractor drive housing and through a horizontally slidable eccentric plate, and an eccentric bushing rotatably carried in the eccentric plate fastened to the idler shaft, wherein rotation of the eccentric bushing in a first direction causes the idler shaft to vertically raise the idler roller assembly above the drive roller assembly and rotation of the eccentric bushing in an opposite direction causes the idler shaft to vertically lower the idler roller assembly into contact with the drive roller assembly.

3. The apparatus according to claim 2 wherein each of the drive and idler roller assemblies includes a spline hub, a spline gear and a spline roller and wherein the spline gear and roller are removably fastened to the spline hub.

4. The apparatus according to claim 3 wherein the slidable idler shaft slide plate is vertically guided by a pair of vertical guides alongside the vertical slot and the eccentric plate is guided along a horizontal guide on an exterior surface of the tractor drive housing.

5. The apparatus according to claim 1 further comprising a radial handle attached to the eccentric bushing for manually rotating the eccentric bushing in the first direction and the opposite direction.

6. The apparatus according to claim 1 wherein the positioner arm is an L shaped member having a short leg fastened to the clamp assembly and a long leg adapted to extend along an axis of the pipe to be cleaned.

7. The apparatus according to claim 6 wherein the long leg of the positioner arm fits within an end of the T or L shaped support member and includes a cross bore for receiving a removable pin through the support member and the long leg of the positioner arm to position the stem of the T or L shaped support member spaced from the end of the pipe to be cleaned.

8. The apparatus according to claim 1 further comprising a splash guard fastened to the pipe side portion of the collet block.

9. The apparatus according to claim 8 wherein the splash guard comprises a flat disk on a stem fastened to the pipe side portion of the collet block.

10. The apparatus according to claim 1 wherein the tractor drive housing has a fixed side wall fastened to opposite end walls each supporting a hose guide tube, and an openable side wall opposite the fixed side wall and wherein one of the hose guide tubes is fastenable to the tractor side portion of the collet block.

11. A tractor drive apparatus for feeding a flexible lance into a pipe to be cleaned, the tractor drive apparatus comprising:

a tractor drive housing to which is fastened a pneumatic drive motor and a drive gearbox; and a tractor drive roller assembly and an idler roller assembly carried within the drive housing, wherein the drive roller assembly is fastened to a drive axle extending into the housing from the drive gearbox and the idler roller assembly is adjustably supported parallel to the drive axle supporting the drive roller assembly by an idler shaft within the tractor drive housing mounted on a slidable idler shaft slide plate, wherein the idler shaft extends parallel to the drive axle out of the tractor drive housing through a slot in the tractor drive housing and through a slidable eccentric plate, and an eccentric bushing rotatably carried in the eccentric plate fastened to the idler shaft, wherein rotation of the eccentric bushing in a first direction causes the idler shaft to raise the idler roller assembly above the drive roller assembly and rotation of the eccentric bushing in an opposite direction causes the idler shaft to lower the idler roller assembly into contact with the drive roller assembly.

12. The apparatus according to claim 11 wherein the drive roller assembly comprises a spline hub fastened to the drive axle, a spline gear and a spline roller mounted on the spline hub against a face plate fastened to the drive axle.

13. The apparatus according to claim 12 wherein the idler roller assembly comprises another spline hub fastened to an idler shaft, another spline gear mounted on the another spline hub, and another spline roller mounted on the another spline hub against another face plate fastened to the spline hub.

14. The apparatus according to claim 11 wherein the slidable idler shaft slide plate is guided by a pair of guides alongside the slot and the eccentric plate is guided along another guide on an exterior surface of the tractor drive housing.

15. The apparatus according to claim 11 further comprising a radial handle attached to the eccentric bushing for manually rotating the eccentric bushing in the first direction and the opposite direction.

16. The apparatus according to claim 11 wherein each of the drive and idler roller assemblies includes a spline hub, a spline gear and a spline roller and wherein the spline gear and roller are removably fastened to the spline hub.

17. The apparatus according to claim 16 wherein each spline hub has an odd number of splines equally spaced around the hub.

18. A tractor drive apparatus for feeding a flexible lance into a pipe to be cleaned, the tractor drive apparatus comprising:

a tractor drive housing having a side to which is fastened a pneumatic drive motor and a drive gearbox; and a tractor drive roller assembly and an idler roller assembly carried within the tractor drive housing, each of the drive and idler roller assemblies including a spline hub, a spline gear and a spline roller and wherein the spline gear and roller are removably fastened to the spline hub, wherein the drive roller assembly is fastened to a drive axle extending into the tractor drive housing from the drive gearbox and the idler roller assembly is adjustably supported parallel to the drive axle supporting the drive roller assembly by an idler shaft within the tractor drive housing mounted on a slidable idler shaft slide plate, wherein the idler shaft extends parallel to the drive axle out of the tractor drive housing through a slot in the tractor drive housing and through a slidable eccentric plate, and an eccentric bushing rotatably carried in the eccentric plate fastened to the idler shaft, wherein rotation of the eccentric bushing in a first direction causes the idler shaft to move the idler roller assembly away from the drive roller assembly and rotation of the eccentric bushing in an opposite direction causes the idler shaft to move the idler roller assembly into contact with the drive roller assembly.

19. The apparatus according to claim 18 wherein the slidable idler shaft slide plate is guided by a pair of guides alongside the slot and the eccentric plate is guided along another guide on an exterior surface of the tractor drive housing.

20. The apparatus according to claim 18 wherein the slidable idler shaft slide plate is vertically guided by a pair of vertical guides alongside the slot and the eccentric plate is guided along an exterior surface of the tractor drive housing.

* * * * *